US006510964B2

(12) United States Patent
Paukov et al.

(10) Patent No.: US 6,510,964 B2
(45) Date of Patent: Jan. 28, 2003

(54) CENTER-PULL SHEET MATERIAL DISPENSER

(75) Inventors: Ladislav Paukov, Delta (CA); Jed C. Friesen, Vancouver (CA); Daniel J. Morton, Saskatchewan (CA)

(73) Assignee: Englewood Ventures, Inc. (CA)

( * ) Notice: Subject to any disclaimer, the term of this patent is extended or adjusted under 35 U.S.C. 154(b) by 45 days.

(21) Appl. No.: 09/861,514

(22) Filed: May 22, 2001

(65) Prior Publication Data

US 2002/0056718 A1 May 16, 2002

Related U.S. Application Data

(63) Continuation-in-part of application No. 09/709,372, filed on Nov. 13, 2000.

(51) Int. Cl.[7] ..... B65H 1/00
(52) U.S. Cl. ..... 221/33; 221/303
(58) Field of Search ..... 221/33, 45, 47, 221/63, 303; 225/106, 52; 242/615.2, 615.3

(56) References Cited

U.S. PATENT DOCUMENTS 5,246,137 A 9/1993 Schutz
5,310,083 A 5/1994 Rizzuto
5,370,338 A 12/1994 Lewis
5,715,971 A 2/1998 Morand
5,749,492 A * 5/1998 Petterson ..... 221/1
5,765,718 A 6/1998 Grasso

FOREIGN PATENT DOCUMENTS

EP 0740921 11/1996
EP 0836825 4/1998

* cited by examiner

*Primary Examiner*—Kenneth W. Noland
(74) *Attorney, Agent, or Firm*—Hall, Priddy, Myers & Vande Sande

(57) ABSTRACT

The invention consists of a paper towel dispenser for dispensing individual sheets of paper towels from a roll of paper having regularly spaced apart lines of partial severance. The dispenser is comprised of a housing and a housing door which can be pivotally opened to allow a roll of sheet material to be inserted into the dispenser. The dispenser has a funnel-shaped exit to allow the end of the roll to protrude in order to be grasped by the user. A paper towel tearing member is located adjacent to the exit aperture of said funnel and the opening of this member is adjustable in order to vary the size of the opening of the dispenser. This adjustment of the exit size creates an adjustment in the position at which the sheet tears away from the roll to allow the use of different types of sheet material in a single dispenser.

14 Claims, 6 Drawing Sheets

CENTER-PULL SHEET MATERIAL DISPENSER

RELATED APPLICATION

This application is a continuation-in-part of U.S. patent application Ser. No. 09/709,372 filed Nov. 13, 2000, all of which is herein incorporated by reference.

FIELD

This invention relates to a dispenser for sheet material, particularly to a dispenser that dispenses individual sheets of a material, such as paper towels, from the center of a coreless roll divided into a plurality of sheets by partially severed spaced apart lines.

BACKGROUND

A number of dispensers exist in the prior art for dispensing paper towels and similar sheet materials. One method of dispensing involves a "center-pull" mechanism whereby the sheet material is removed from the center of a coreless roll. The sheet material is pulled through a restricted opening that frictionally resists the pulling motion from the user. This resistance results in the sheet material tearing away into individual sheets at predetermined points marked by partially severed lines.

The most common design of a center-pull dispenser uses a cone or funnel shaped nozzle to provide the opening for resisting and dispensing the sheet material. This design provides a large initial entrance for the end of the sheet material roll that allows for easy insertion of the end of a new roll, while also having the restricted exit opening necessary to provide sufficient resistance to allow tearing of the perforations.

There are a couple of problems with the current center-pull dispenser designs. First, some dispensers have the point of the opening formed by the casing which is of a relatively inexpensive plastic. The repeated passage of the sheet material against the exit opening wears down this plastic, eventually making the opening too large to provide proper resistance for tearing the perforations. In most cases, the entire unit must be replaced to resolve this problem.

A second problem is the need for multiple dispensers for different types of sheet materials. Different grades of sheet material require exit openings of different sizes and shapes. Ideally, a sheet material dispenser should be adjustable to allow dispensing of different grades of sheet material.

Therefore, it is an object of this invention to provide a sheet material dispenser that has a modified exit opening that eliminates wear caused by friction from the sheet material. It is a further object of this invention to provide a sheet material dispenser that minimizes the chance of the sheet material jamming in the dispenser during operation.

It is a further object of this invention to provide a sheet material dispenser with an exit opening that can be adjusted in shape or size to allow the dispensing of different grades of sheet material.

SUMMARY

The invention consists of a paper towel dispenser for dispensing individual sheets of paper towels from a roll of paper having regularly spaced apart lines of partial severance. The dispenser is comprised of a housing and a housing door which can be pivotally opened to allow a roll of sheet material to be inserted into the dispenser. The dispenser has an exit aperture at the bottom to allow the end of the roll to protrude in order to be grasped by the user. This exit aperture is preferably located between the axis of the dispenser and the housing door in such a way as to provide space between the roll end and the wall on which the dispenser is mounted for a user to grasp the roll end.

The interior of the dispenser has a funnel-shaped platform which supports the roll of sheet material above the exit of the dispenser. The funnel-shaped platform has a rotatable ring attached at its exit. The rotatable ring has a slot which aligns with a corresponding slot in the platform to allow for the sheet material to be passed through when loading a new roll of sheet material into the dispenser. The rotatable ring is then rotated so the slot in the ring is no longer aligned with the slot in the platform. The misalignment of the two slots reduces the chances of the sheet material jamming in the platform slot during dispensing.

A paper towel tearing member is located adjacent to the exit aperture of the funnel and the opening of this member is adjustable in order to vary the size of the opening of the dispenser. This adjustment of the exit size creates an adjustment in the position at which the sheet tears away from the roll to allow the use of different types of sheet material in a single dispenser.

Optionally, a wear-resistant ring, preferably made of metal or hard plastic, is located in the housing and surrounds the exit opening, except for a slot, to permit the passage of the roll end. A spacer in the housing door enters a slot in the ring when the housing door-is closed to provide a solid ring enclosing the entire exit opening. When the user pulls on the roll end the material rubs along the plate and the friction creates enough resistance to allow separation of individual sheets of material along predetermined perforations. The ring will be extremely resistant to the wear caused by the repeated use of the dispenser. One preferred shape for the ring is an elongated rectangle.

The adjustment of the paper towel tearing member may be provided by a sliding plate composed of the same wear-resistant material as the ring.

Preferably, the ring is also removable, to allow replacement of the ring in order to adjust the shape of the exit opening to accommodate different grades of sheet material.

The ring and sliding plate assemblies can also be combined in the paper towel tearing member to provide the widest range of adjustment possibilities.

BRIEF DESCRIPTION OF THE DRAWINGS

The invention itself, both as to organization and method of operation, as well as additional objects and advantages thereof, will become readily apparent from the following detailed description when read in connection with the accompanying drawings.

DETAILED DESCRIPTION

Figure 1:
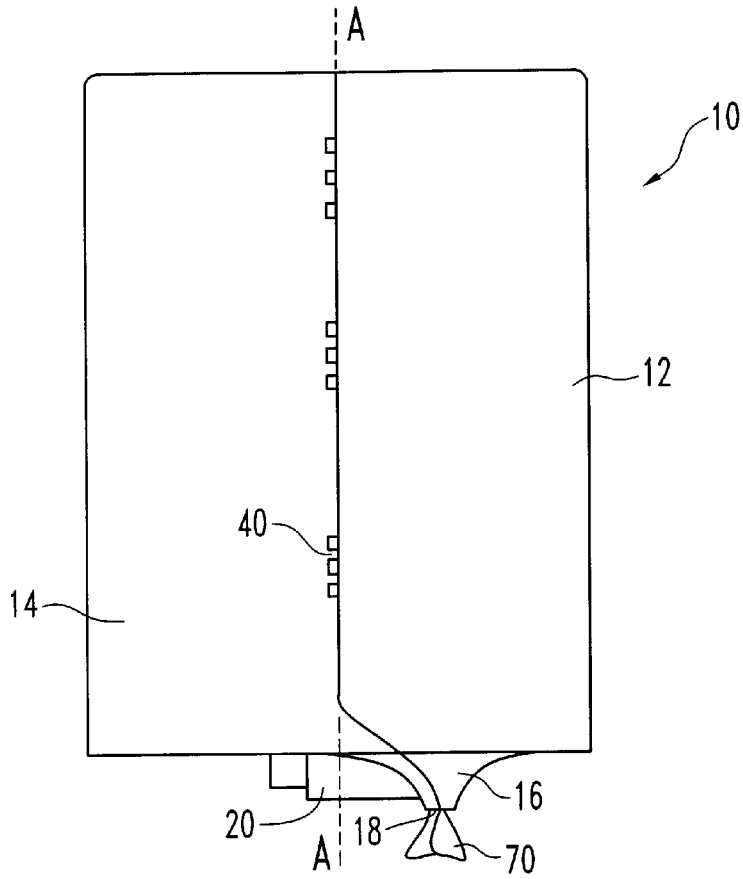
FIG. 1 is a side view of a closed dispenser.

FIG. 1 shows the closed dispenser 10 for dispensing individual sheets from a roll of sheet material divided into a plurality of sheets by partially severed spaced apart lines. The dispenser 10 consists of a housing door 12 and a housing 14. In the embodiment shown, a funnel outlet 16 is preferably located forward of a center axis A—A of the closed dispenser 10. By locating the funnel outlet 16 forward of the center axis A—A, there is an increase in the space available to the user for grasping the projecting roll end 70 when the dispenser is mounted on a wall. The funnel outlet 16 is also shown with an optional adjustment mechanism 20 located behind the funnel exit opening 18. In the current embodiment, the hinges 40, which allow the closed dispenser 10 to be opened by rotating the housing door 12 away from the housing 14, are located on an exterior side of the dispenser 10. A locking clasp (not shown) or similar mechanism is used to hold the housing door 12 in the closed position. The roll end 70 of the sheet material projects through the exit opening 18 to be grasped by a user.

Figure 2:
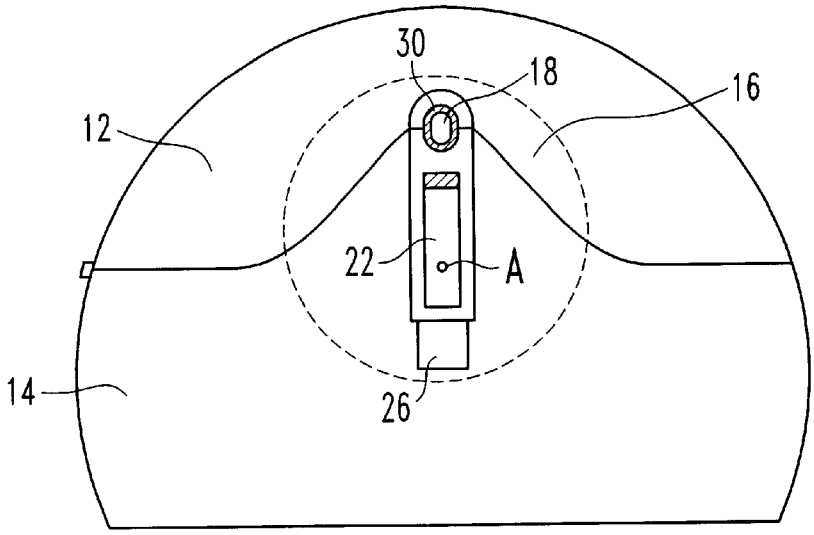
FIG. 2 is an end view of the base of a closed dispenser.

FIG. 2 shows an end view of the closed dispenser 10, with the funnel outlet 16 and the exit opening 18. The adjustment mechanism 20 is also shown. In the current embodiment, the adjustment mechanism 20 consists of a sliding plate 22. A portion of a ring 30 defining the exit opening 18 is also visible around the exit opening 18 and below the sliding plate 22. The ring 30 and the sliding plate 22 are made of metal to prevent any wear from the repeated passage of the sheet material. However, any suitably resistant material, such as a hard plastic, could also be used.

Figure 3:
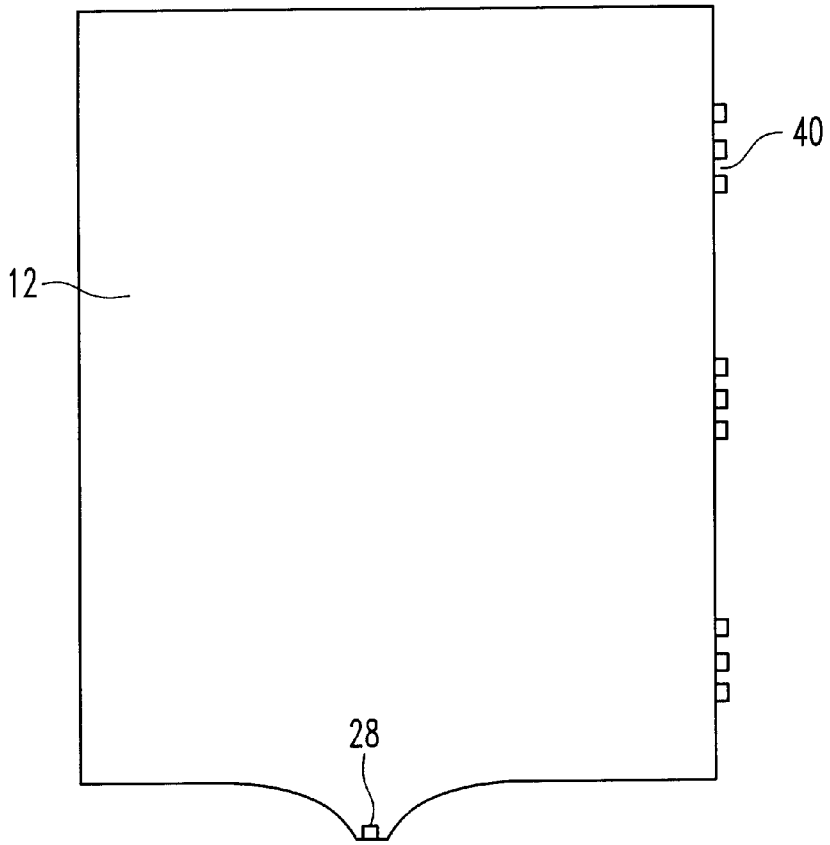
FIG. 3 is an interior view of the housing door.

FIG. 3 shows the interior of the housing door 12. A spacer 28 is located at the edge of the exit opening 18 (as shown in FIG. 2) when the housing door 12 is closed against the housing 14 (as shown in FIG. 4).

Figure 4A:
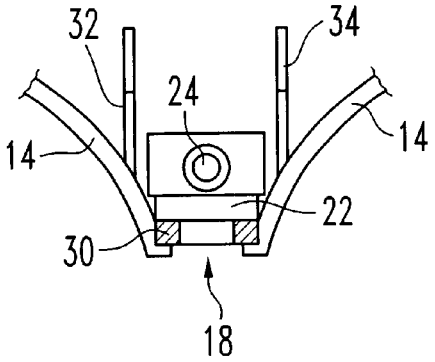
FIG. 4*a* is a close-up of the lower interior of the housing without the platform funnel collar visible.
Figure 4B:
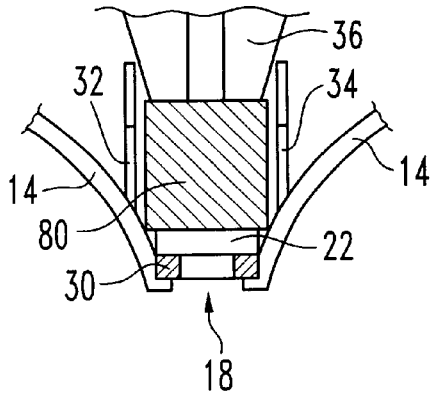
FIG. 4*b* is a close-up of the lower interior of the housing with the platform funnel collar visible.
Figure 4:
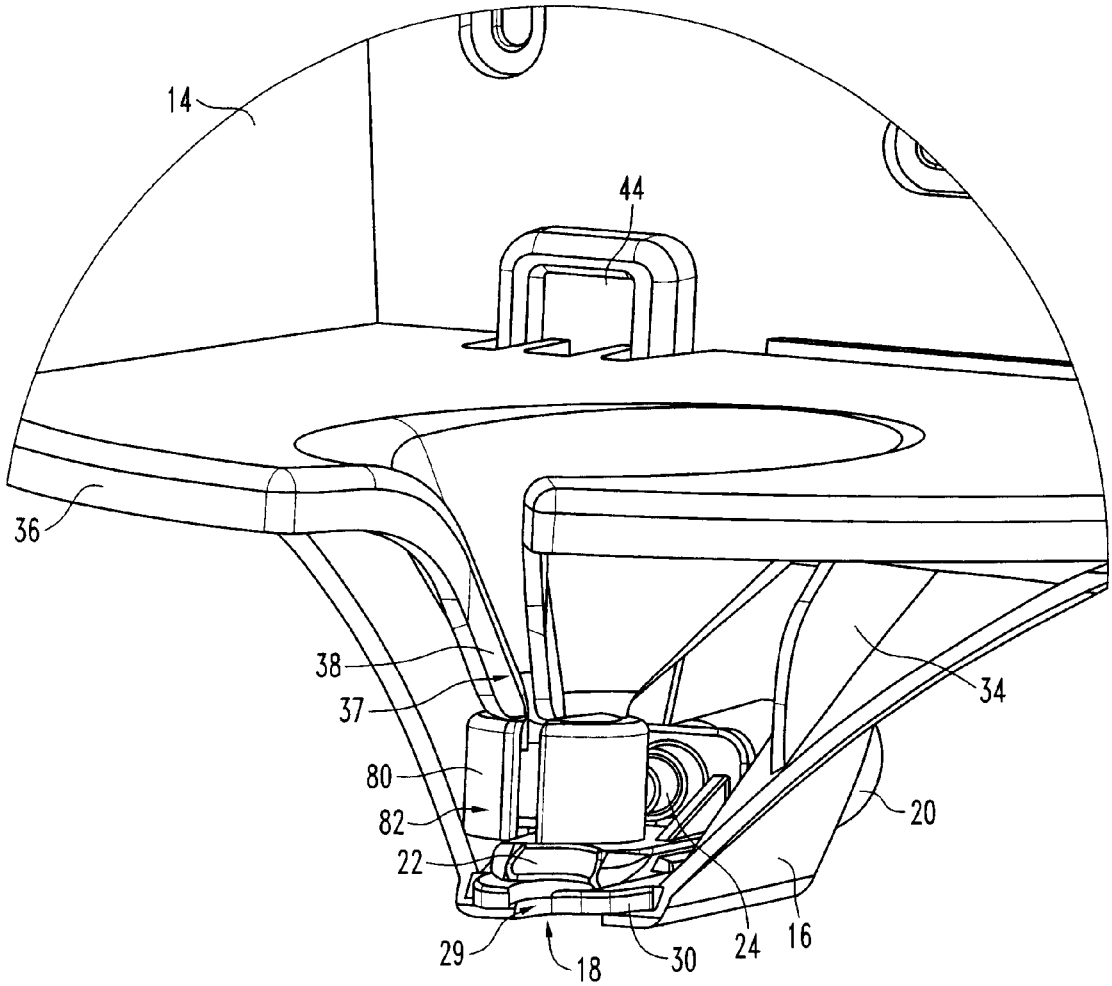
FIG. 4 is a cut-away view of the housing.

FIGS. 4, 4*a*, and 4*b* show the base of the interior of the housing 14. Any conventional method can be used to secure the housing 14 to a wall for use. For example, holes may be included in the back of the housing 14 to allow for screws to secure the housing 14 to a wall. The two projections 32 and 34 (see FIG. 4*a*) in the funnel outlet 16 support a platform 36 which holds the roll (not shown) of sheet material and allows the roll to rotate as the roll end 70 (see FIG. 1) is pulled by the user. The platform 36 is attached to the housing 14 at slots 44. The platform 36 has a funnel-shaped opening 38 dimensioned to fit inside the funnel outlet 16 of the housing 14 and to allow space between the end of the funnel-shaped opening 38 and the exit opening 18 for the ring 30 and sliding plate 22.

The platform 36 has a collar 80 with a slot 82 attached at the end of the funnel-shaped opening 38. The collar 80 is rotatable such that slot 82 can be aligned with the slot 37 in the platform 36 to insert a new roll as described below. During operation, the slot 82 is misaligned from the slot 37 to prevent jamming of the dispenser that may otherwise result from the sheet material being caught in the slot 37 during dispensing.

As seen in FIG. 4*b*, the collar 80 extends down to the sliding plate 22. In an embodiment without the sliding plate 22, the collar 80 should extend to the ring 30 which surrounds the exit opening 18. In this manner, the sheet material is surrounded at all times during dispensing, thereby minimizing the risk of the sheet material becoming jammed in any part of the dispenser 10 during dispensing. The sliding plate 22 and the ring 30 are located immediately above the exit opening 18.

The sliding plate 22 and ring 30 are mounted on the housing 14 because of the large size of the housing 14 compared to the housing door 12. The large size of the housing 14 is a result of locating the funnel outlet 16 forward of the center axis A—A (as shown in FIG. 1). While the described configuration is considered optimal, it is conceivable that either or both of the sliding plate 22 and the ring 30 could be located on the housing door 12 in an alternative embodiment.

Figure 5:
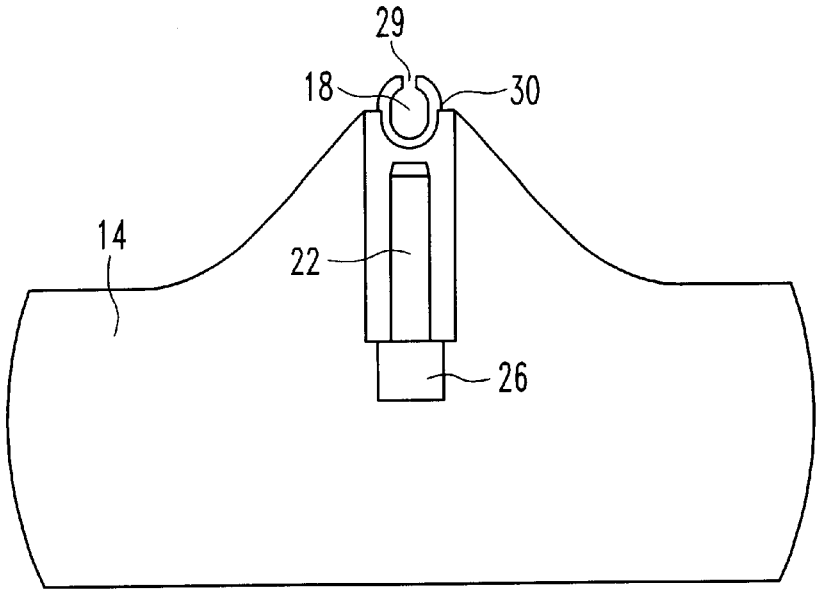
FIG. 5 is an end view of the housing.

FIG. 5 shows an end view of the exterior of the housing 14. The ring 30 has a gap 29 to accept the spacer 28 (shown in FIGS. 3 and 6). The shape of the ring 30 defines the exit opening 18 and the ring 30 is preferably removable to allow the use of differently shaped rings for different grades of sheet material without replacing the dispenser 10 (as shown in FIG. 1).

Figure 10:
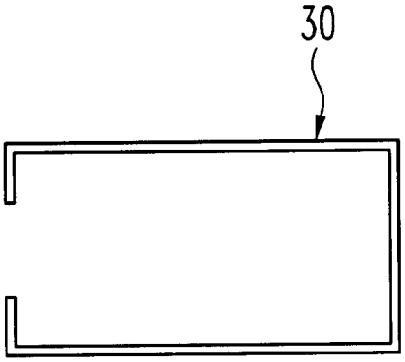
FIG. 10 is a typical ring, shown in an elongated rectangular shape.

FIG. 10 shows a typical ring 30, shaped as an elongated rectangle. The elongated rectangular shape allows for tearing of the sheet material when the user pulls the roll end in any direction. Due to the small size of the ring 30, it may be possible to provide a space in the housing door 12 or the housing 14 to store excess rings to allow a single dispenser to handle various grades of sheet material.

Figure 6:
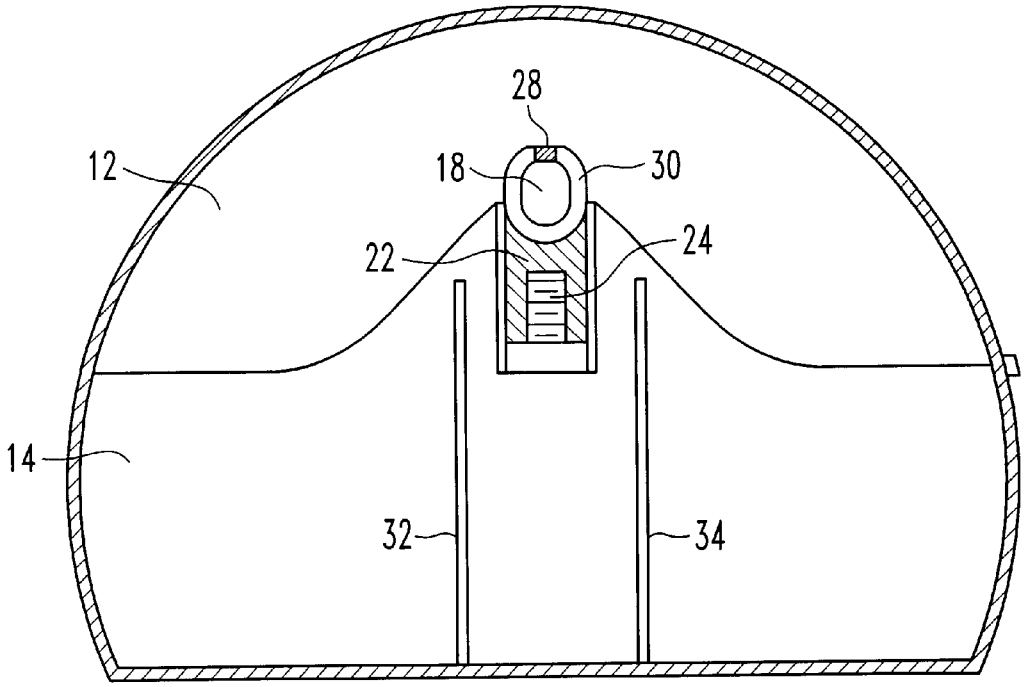
FIG. 6 is an interior view of the closed dispenser with the platform removed.
Figure 6A:
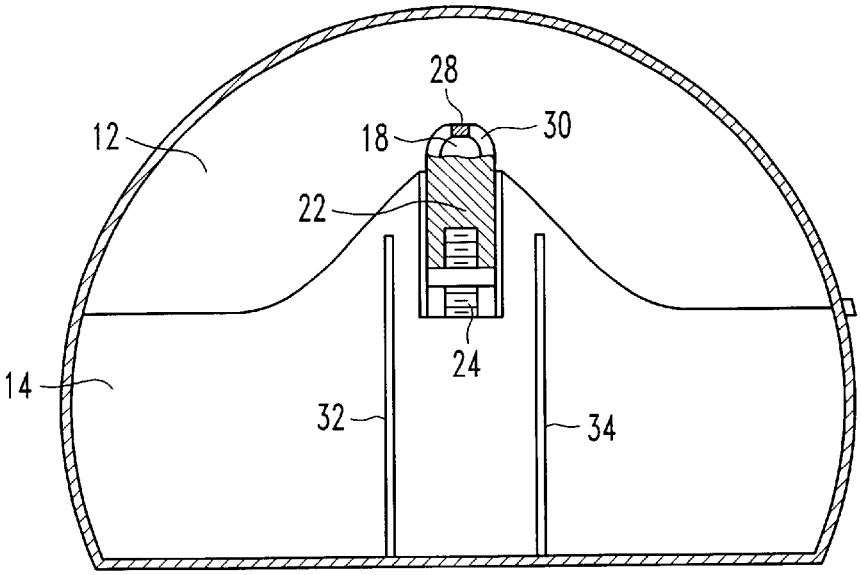
FIG. 6*a* is an interior view of the closed dispenser showing the sliding plate in an extended position.

FIG. 6 is an interior view showing the base of the closed dispenser 10 with the platform 36 (shown in FIG. 4) removed. The spacer 28 is inserted into the gap 29 (shown in FIG. 5) in the ring 30 to completely enclose the exit is opening 18 when the housing door 12 is closed against the housing 14. The sliding plate 22 is shown in a fully retracted position, leaving the entire exit opening 18 in the ring 30 exposed. Preferably, the sliding plate 22 has a rounded end to match the rounded shape of the exit opening 18. FIG. 6*a* shows the same view with the sliding plate 22 in a partially extended position to partially cover the exit opening 18.

Figure 7:
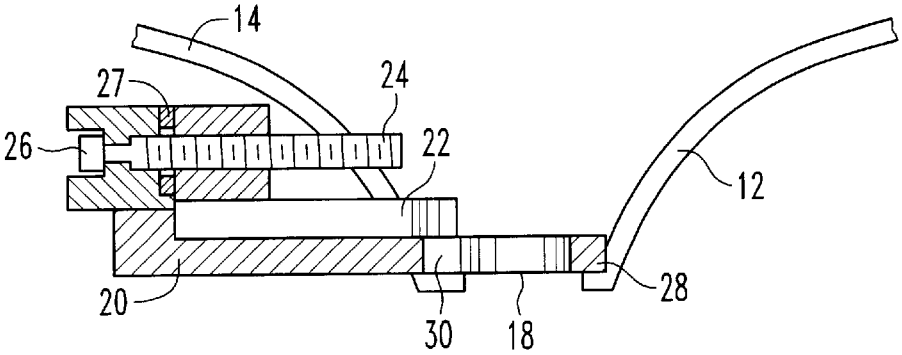
FIG. 7 is a cross section of the adjustment mechanism in the closed dispenser.
Figure 8:
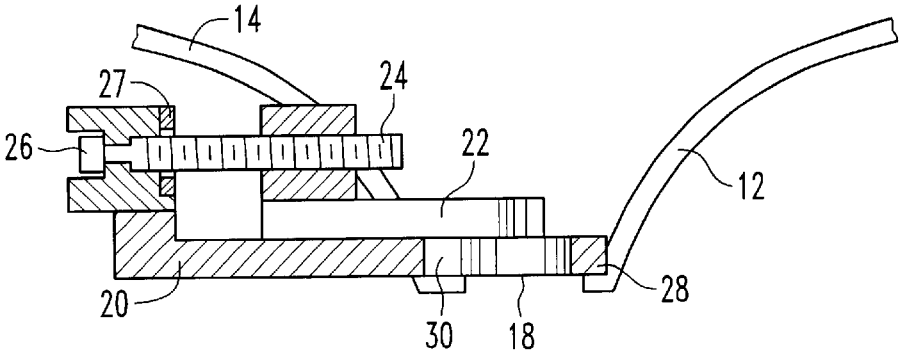
FIG. 8 is a cross section of the adjustment mechanism showing the sliding plate in an extended position.

FIG. 7 is a cross section of the adjustment mechanism 20. The sliding plate 22 is located directly above the ring 30 and the spacer 28. The position of the sliding plate 22 is adjusted to reduce or enlarge the size of the exit opening 18. In the embodiment shown, a threaded fastener 24 connected to the sliding plate 22 and to an adjustment knob 26 provides this adjustment. The rotation of the adjustment knob 26 moves the sliding plate 22 along the fastener 24 while washer 27 retains fastener 24 in position. The adjustment knob 26 is positioned such that it can be accessed from the exterior of the closed dispenser 10 (as shown in FIG. 1). As a result, it may optionally include some anti-tamper means to prevent user interference with the dispensing process such as a unique screw head. FIG. 8 shows the same view with the sliding plate 22 in a partially extended position, partially covering the exit opening 18.

Figure 9:
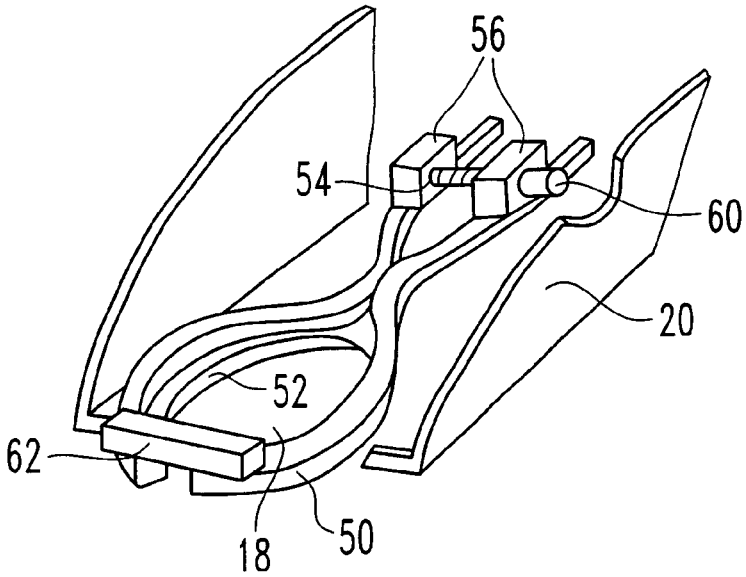
FIG. 9 is a cut-away view of an alternative embodiment for the adjustment mechanism.

FIG. 9 shows an alternative embodiment for the adjustment mechanism 20. A pair of curved bars 50 and 52 are used in place of the ring 30. A fastener 54 passed through blocks 56 connects the curved bars 50 and 52. The fastener 54 can be tightened (to expand the opening) or loosened (to reduce the opening). A hole 60 is positioned to provide access to the fastener 54 for adjustment. A bar 62, preferably attached to the housing door 12, rests on top of the ends of the curved bars 50 and 52 to fully enclose the exit opening 18. This alternative embodiment is shown without the sliding plate 22 (as seen in FIG. 4), however, it can be anticipated that a design that combines the curved bars 50 and 52 with a sliding plate 22 is also possible.

In operation of a unit designed according to the preferred embodiment, a roll of sheet material is mounted inside the closed dispenser 10. The roll end 70 of the sheet material roll (see FIG. 1) runs through the funnel-shaped opening 38 in platform 36, through the collar 80 and through the exit opening 18. The user pulls the sheet material, which frictionally contacts the ring 30. The force exerted by a user, and the associated friction against the ring 30, increases until the partially severed line extends out of the exit opening 18 a predetermined distance, at which point the sheet material tears along the partially severed line. The torn end of the sheet material protrudes through the exit opening 18, ready for use by another user.

Installing and replacing a roll of sheet material is facilitated by the housing construction. The housing door 12 is opened and pivoted out of position along the hinges 40. A roll of sheet material is then inserted into the housing 14, which is mounted to a wall. The collar 80 is rotated so the slot 82 is aligned with the slot 37 in the platform 36. The end of the roll is then passed through the slot 37, the slot 82 in the collar 80 and the gap 29 in the ring 30. The collar 80 is then rotated so that the slot 82 is no longer aligned with the slot 37. The collar 80 prevents the sheet material from being caught in the slot 37 during dispensing and therefore greatly reduces the chance -of the dispenser jamming. The housing door 12 is then closed against the housing 14. The spacer 28 fits into the gap 29 in the ring 30 to form a closed ring surrounding the protruding roll end 70. Other embodiments would be expected to function in a manner similar to the one described above.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the scope of the invention.

We claim:

1. A paper towel dispenser for dispensing individual sheets of paper towels from a roll of paper having regularly spaced apart lines of partial severance, between each pair of which is defined one of said individual sheets, comprising:

a) a hollow housing for receiving said roll;

b) a housing door attached to said hollow housing and reversibly moveable from a closed position to an open position;

c) a region at the bottom of said hollow housing terminating in a housing exit aperture and having an opening along one side to permit entry of an end region of said roll;

d) a funnel-shaped platform with a slot mounted within said hollow housing operative to hold said roll, said funnel-shaped platform having a platform exit aperture coincident with the housing exit aperture;

e) a rotatable collar having a slot, said rotatable collar located adjacent to the platform exit aperture such that the slot is reversibly rotatable from a position in which it is aligned with the slot in said funnel-shaped platform to a position out of alignment with the slot in said platform; and f) a paper towel tearing member positioned adjacent to the housing exit aperture and external to an interior of said hollow housing, having an opening aligned with the housing exit aperture and adjustable to vary the size of said opening so as to adjust the position at which each sheet tears away from said roll.

2. A dispenser according to claim 1, wherein the housing exit aperture is positioned between an axis of said dispenser and said housing door so as to provide sufficient clearance for a user's hand between an end of said roll and a wall to which said dispenser is mounted.

3. A dispenser according to claim 1, wherein said paper towel tearing member includes a wear-resistant ring around the housing exit aperture with an opening to allow passage for the end region of said roll and a spacer in the housing door that inserts in said opening such that the ring and spacer combine to completely enclose the housing exit aperture when the housing door is closed against the housing.

4. A dispenser according to claim 3, wherein said wear-resistant ring is removable.

5. A dispenser according to claim 3, wherein said wear-resistant ring is made of metal.

6. A dispenser according to claim 3, wherein said wear-resistant ring is of an elongated, rectangular shape.

7. A dispenser according to claim 1, wherein said paper towel tearing member includes a slidable wear-resistant plate that can be slidably adjusted to vary the size of said opening in the housing exit aperture.

8. A dispenser according to claim 7, wherein said slidable wear-resistant plate is made of metal.

9. A dispenser according to claim 3, wherein said paper towel tearing member includes a slidable wear-resistant plate located adjacent to said wear-resistant ring that can be slidably adjusted to cover and uncover said ring and adjust the size of the housing exit aperture.

10. A dispenser according to claim 9, wherein said wear-resistant ring is removable.

11. A dispenser according to claim 9, wherein said wear-resistant ring and said wear-resistant plate are both made of metal.

12. A dispenser according to claim 9, wherein said wear-resistant ring is of an elongated, rectangular shape.

13. A dispenser according to claim 1, wherein said paper towel tearing member includes a first wear-resistant bar and a second wear-resistant bar positioned around the housing exit aperture with an opening to allow passage for the end region of said roll and a third wear-resistant bar in the housing door that covers said opening such that the first bar, the second bar and the third bar combine to completely enclose the housing exit aperture when the housing door is closed against the housing, wherein said first bar and said second bar can be moveably adjusted to vary the size of said opening in the housing exit aperture.

14. A dispenser according to claim 13, wherein said first wear-resistant bar, said second wear-resistant bar and said third wear-resistant bar are made of metal.

* * * * *